US005921393A

United States Patent [19]

Diderich

[11] Patent Number: 5,921,393

[45] Date of Patent: Jul. 13, 1999

[54] SEPARATOR FOR SHEETS

[75] Inventor: Johannes Plilippus Ludovicus Maria Diderich, BD Ermelo, Netherlands

[73] Assignee: Besin B.V., BD Ermelo, Netherlands

[21] Appl. No.: 09/051,111

[22] PCT Filed: Oct. 4, 1996

[86] PCT No.: PCT/NL96/00386

§ 371 Date: Sep. 8, 1998

§ 102(e) Date: Sep. 8, 1998

[87] PCT Pub. No.: WO97/12817

PCT Pub. Date: Apr. 10, 1997

[30] Foreign Application Priority Data

Oct. 6, 1995 [NL] Netherlands ..... 1001362

[51] Int. Cl.[6] ..... B65D 63/00

[52] U.S. Cl. ..... 206/454; 206/593

[58] Field of Search ..... 206/449, 453, 206/454, 456, 591, 593, 594

[56] References Cited

U.S. PATENT DOCUMENTS 1,582,722 4/1926 Adams .

3,708,946 1/1973 Cahill ..... 206/593 X 5,132,156 7/1992 Trassare, Jr. et al. ..... 206/593 X

FOREIGN PATENT DOCUMENTS 0375563 6/1990 European Pat. Off. .

2229235 12/1974 France .

3422305 10/1985 Germany .

*Primary Examiner*—Jacob K. Ackun

*Attorney, Agent, or Firm*—Ladas & Parry

[57] ABSTRACT

The invention relates to a separator (1) for sheets, in particular fragile sheets such as glass sheets, a comprising a strip of support material (2) with a protruding nose at one end. According to the invention, the nose consists of a square angle section (3) with a first (4) and a second leg (5), wherein the angle section (3) is fitted with its first leg (4) into a recess at the end of the strip of support material (2). Preferably, the angle section (3) consists of solid carton and the strip of support material consists of a strip of honeycomb panel.

14 Claims, 1 Drawing Sheet

SEPARATOR FOR SHEETS

The invention relates to a separator for sheets, in particular fragile sheets such as glass sheets, comprising a strip of support material with a protruding nose at one end.

Such separators are used in the glass sheet industry. The glass leaves the glass melting furnace as a continuous web, which is cut into sheets, after which the sheets are placed upright against each other. The sheets for instance have a height of 3 meters and a width of 6 meters. In order to be able to transport several sheets simultaneously, a number of separators are fitted for instance every 8 to 10 sheets, so that an interspace is created between each packet of glass sheets. Known separators have a thickness of approximately 25 mm. The known separators are usually made of plastic or paper material in order to acquire sufficient strength at a low weight.

The separators are automatically fitted onto a glass sheet after the latter has been cut off, either prior to placing it in a vertical position or during of after it is placed in a vertical position. So as to prevent the separators from sliding down, they are provided at one end with a thickening, called nose in the field, which hooks behind the upper edge of the glass sheet. In order to prevent that a separator shifts or falls off the glass sheet, for instance during manipulation of the glass sheet, the separator can be provided, at the side of the nose, with a detachable connecting means, such as a suction cup.

A drawback to the known separators is that the nose, which is also made of synthetic material or paper material such as a number of layers of corrugated board, must have a height of at least 4 cm in order to possess sufficient shearing strength to bear the separator, since the separator is suspended with its entire weight from its nose. The nose is usually 4 to 8 cm high; a usual height is 6 cm. Consequently, the separator protrudes with the nose 6 cm above the glass sheets, thereby requiring additional transport height and additional storage space for the glass sheets and increasing the risk of damaging the protruding ends of the separators.

It is an object of the invention to improve upon this situation.

This object is realized, according to the invention, with a separator of the type described in the introduction, in which the nose consists of a square angle section with a first and a second leg, wherein the angle section is fitted with its first leg into a recess at the end of the strip of support material.

This ensures that the first leg contacts the strip of support material over a sufficient height to withstand the shearing forces caused by the weight of the separator, while the second leg of the angle section protrudes from the strip of support material. The thickness of this second leg of the, angle section can consequently be far less than the height of the known noses, so that the separator only has to protrude above the glass sheets for at most the thickness of the second leg of the angle section. An additional advantage of this is that the strip of support material can have a shorter length. If the strip extends up to the upper face of the second leg of the angle section, the upper edge of the strip will be located at a distance equal to the (small) thickness of the second leg above the glass sheets. If the length of the first leg is sufficient with a view to the required shear force transfer between nose and strip, the upper edge of the strip may be at a lower level, wherein it is even possible that the first leg of the angle section protrudes above the upper edge of the strip with some of its length. In the latter case, a split will be formed between a nose and an upper edge of a subsequent glass sheet due to the recessed location of the upper edge of the strip.

The second leg of the angle section preferably protrudes on the side of the strip of support material where the recess in the shape of a recessed portion has been provided, so that the moment which is applied on the transition from the first leg of the angle section to the second leg, remains low.

The recess is advantageously as deep as the first leg of the angle section is thick, so that the thickness of the support is constant across the entire bearing length. If a deeper recess were used, the moment on the transition between the first and the second leg will increase, which is undesirable, and in the case of a shallower recess the first leg will protrude outside the strip of support material, as a consequence of which the separator will be too thick in that location.

Preferably, the first and/or the second leg of the angle section is substantially equally wide as the strip of support material, so that the angle section can be executed as thin as possible.

According to an advantageous embodiment, the angle section is made of paper material, preferably solid cardboard. In the case of a support of paper material, the entire separator can be recycled, and with solid cardboard the legs of the angle section can remain thin.

The angle section preferably consists of layers of paper laminated together, which paper is recycled, photographic paper in a preferred embodiment. The angle section is hereby given great strength, the photographic paper offering an inexpensive base material.

The strip of support material preferably consists of a strip of honeycomb panel, where at one end a recess in the shape of a recessed portion has been pressed in. Honeycomb panel is a very light and stiff material, into which a recessed portion can easily be pressed. If a synthetic support material were to be used, the recessed portion would have to be cut out, which is more laborious.

The first leg of the angle section is advantageously glued into the recessed portion of the honeycomb support, preferably with hot melt glue, whereby the angle section can easily and simply be secured to the strip of support material.

The second leg of the angle section preferably protrudes 10 to 40 mm outside the support material, depending on the thickness of the packet of (glass) sheets.

The invention will be elucidated on the basis of an exemplary embodiment, with reference to the accompanying drawing.

A separator usually has a length of 2–3.35 m, a width of 60–120 mm and a thickness of 20–60 mm. For the user the compression strength is of primary importance: this is approximately 350–400 kPa. The separator therein consists of three layers, of which the central layer forms a honeycomb structure and the two outer layers, which contact the glass, are made of paper of which the acidity level is neutral. The central, honeycomb-shaped layer is composed of strips of paper, folded and glued together in such a way, that a structure is created which consists of a large series of interconnected walls which enclose similar prismatic hexagonal spaces, The walls of these hexagonal spaces are positioned upright between the two above-mentioned outer layers (cover layers) and are connected thereto by means of the glue in such a manner that shearing forces (in the plane) can be transferred onto the opposite cover layer. In this manner a rigid and light prismatic beam is created with a high compression strength. The hexagonal spaces or cells therein usually have an inner diameter of 10 to 30 mm. The paper which is used for the hexagonal spaces therein has a mass of 150–300 g/m$^2$ and the paper which is used for the cover layers has a mass of 150–750 g/m$^2$. The glue which is used to compose such a honeycomb panel, that is to say the honeycomb layer with both cover layers, can be an ordinary, commercially available glue which is suitable for paper. The paper which is used is of a similar quality as the paper used for the manufacture of corrugated board and can consist in part or entirely of recycled old paper and/or in part of entirely of paper of cellulose fibres.

Figure 1:
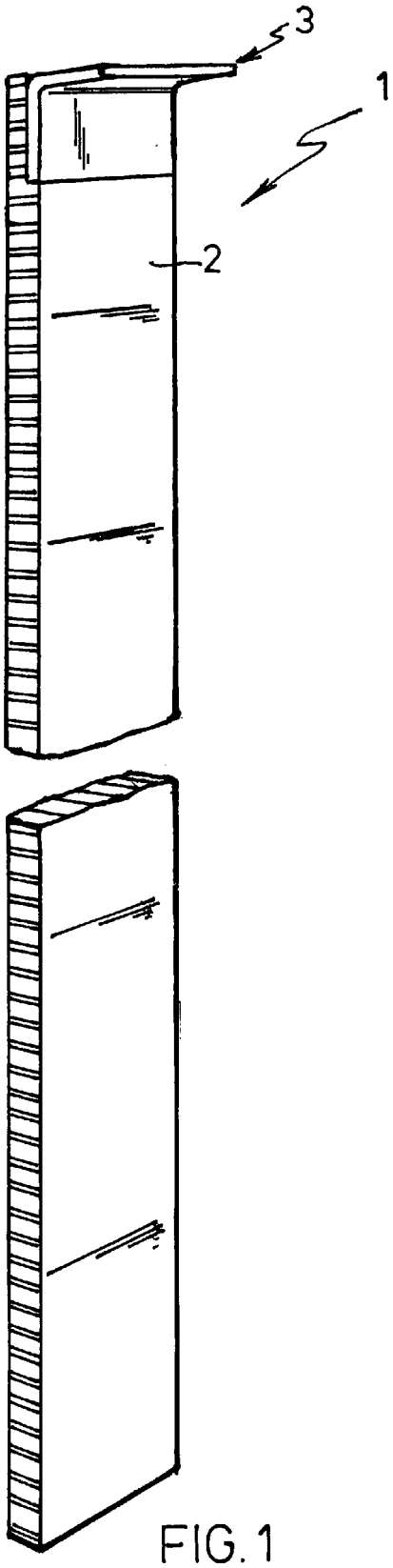
FIG. 1 shows a perspective view of a separator according to the invention.

FIG. 1 shows a separator 1, consisting of a rectangular strip of honeycomb panel 2 which is provided at its top end with a nose, constituted by an angle section 3 made of solid cardboard.

Figure 3:
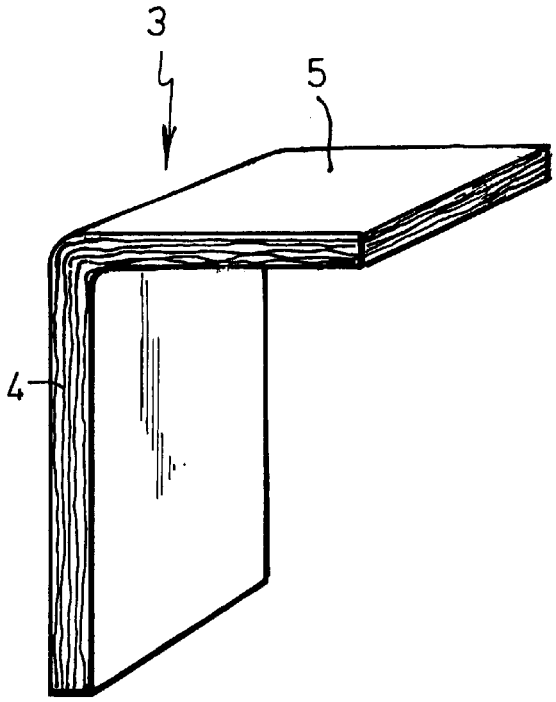
FIG. 3 shows a perspective view, on a larger scale, of the angle section in the separator according to FIG. 1.

FIG. 3 shows that the angle section 3 consists of a first leg 4 and a second leg 5.

Figure 2:
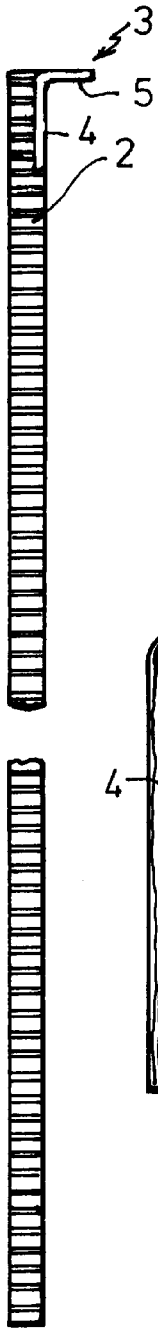
FIG. 2 shows, on a somewhat smaller scale, a side view of the separator According to FIG. 1.

FIG. 2 shows, that at the top end of the strip of honeycomb panel 2 a recess has been provided, into which the first leg 4 of the angle section 3 fits, so that the separator at the location of the first leg 4 is not thicker than the thickness of the rest of the strip of honeycomb panel 2.

FIG. 2 clearly shows that the actual nose of the separator 1 is constituted by the second leg 5 of the angle section 3, as a consequence of which the nose has only a small height. When in use, the separator 1 will consequently only protrude above the glass sheet over a height which is equal to the thickness of the second leg 5 of the angle section 3.

The angle section 3 is preferably as wide as the strip of honeycomb panel 2. In the exemplary embodiment, the strip of honeycomb panel is more than 3 meters long, 80 mm wide and 20 mm thick.

When an angle section, consisting of solid cardboard made of laminated recycled paper,—that is to say made of multiple layers of paper glued together to the desired thickness in angle form with an angle of 90°—is being used, the thickness of the legs 4 and 5 need only be approximately 3 mm. For instance recycled photographic paper can be used as the paper.

In order to obtain sufficient adhesion, by means of a hot melt glue, of the first leg 4 to the recess in the strip of honeycomb panel, the first leg 4 is preferably 60 mm high.

The first leg 4 ends at the level of the upper edge of strip 2. It is possible—however—to have the first leg project above the strip. In order to maintain sufficient bonding between nose and strip, the first leg will then have an increased length.

The second leg 5 of the anile section 3 preferably protrudes 10 to 40 mm outside the strip of honeycomb panel 2.

I claim:

1. Separator for sheets, in particular fragile sheets such as glass sheets, comprising a strip of support material with a protruding pose at one end, characterized in that the nose consists of a square angle section with a first and a second leg, wherein the angle section is fitted with its first leg into a recess at the end of the strip of support material.

2. Separator according to claim 1, characterized in that the second leg of the angle section protrudes on the side of the strip of support material where the recess in the shape of a recessed portion has been provided.

3. Separator according to claim 1, characterized in that the recess is as deep as the first leg of the angle section is thick.

4. Separator according to claim 1, characterized in that the second leg of the angle section is substantially equally wide as the strip of support material.

5. Separator according to claim 1, characterized in that the first leg of the angle section is substantially equally wide as the strip of support material.

6. Separator according to claim 2, characterized in that the first leg has a length which corresponds to the length of the recess.

7. Separator according to claim 2, characterized in that the first leg has a length which is greater than the length of the recess.

8. Separator according to claim 1, characterized in that the angle section is made of paper material.

9. Separator according to claim 8, characterized in that the angle section consists of solid cardboard.

10. Separator according to claim 8, characterized in that the angle section consists of layers of paper laminated together.

11. Separator according to claim 10, characterized in that the paper is recycled photographic paper.

12. Separator according to claim 1, characterized in that the strip of support material consists of a strip of honeycomb panel, where at one end a recess in the shape of a recessed portion has been pressed in.

13. Separator according to claim 12, characterized in that the first leg of the angle section is glued into the recessed portion of the honeycomb support, preferably with hot melt glue.

14. Separator according to claim 1, characterized in that the second leg of the angle section protrudes 10 to 40 mm outside the support material.

* * * * *